US006280817B1

(12) United States Patent
McCrossin et al.

(10) Patent No.: US 6,280,817 B1
(45) Date of Patent: Aug. 28, 2001

(54) PORTABLE PROTECTIVE FLOOR COVERING MAT FOR APPLIANCES

(76) Inventors: Thomas K. McCrossin, 24 Huntsman Dr., Boothwyn, PA (US) 19061; Louis F. McCrossin, 3846 Brunswick Ave., Drexel Hill, PA (US) 19026

( * ) Notice: Subject to any disclaimer, the term of this patent is extended or adjusted under 35 U.S.C. 154(b) by 0 days.

(21) Appl. No.: 09/212,572

(22) Filed: Dec. 16, 1998

(51) Int. Cl.[7] ..... B32B 3/02

(52) U.S. Cl. ..... 428/81; 428/156; 428/157; 428/192; 16/42 R

(58) Field of Search ..... 428/81, 124, 157, 428/192, 156; 16/42 R; 5/417, 420

(56) References Cited

U.S. PATENT DOCUMENTS

| | | | | |
|---|---|---|---|---|
| 3,362,666 | | 1/1968 | O'Donnell | 248/22 |
| 3,390,414 | | 7/1968 | Kravitt | 15/217 |
| 3,616,118 | | 10/1971 | Porter | 52/613 |
| 3,915,528 | | 10/1975 | Glickman | 312/229 |
| 4,156,048 | | 5/1979 | Davis | 428/354 |
| 4,671,393 | * | 6/1987 | Rainey | 5/417 |
| 4,784,888 | * | 11/1988 | Schwertner et al. | 428/81 |
| 4,801,005 | | 1/1989 | Hahn | 141/98 |
| 4,940,620 | * | 7/1990 | Silk et al. | 428/81 |
| 5,018,235 | | 5/1991 | Stamation | 15/215 |
| 5,051,293 | | 9/1991 | Breitscheidel | 428/157 |
| 5,073,428 | * | 12/1991 | Lancelot et al. | 428/67 |
| 5,439,727 | | 8/1995 | Riggs | 428/128 |
| 5,443,885 | | 8/1995 | Wilson | 428/121 |
| 5,506,040 | | 4/1996 | Cordani | 428/218 |
| 5,720,057 | * | 2/1998 | Duncan | 5/420 |

* cited by examiner

*Primary Examiner*—Alexander S. Thomas
(74) *Attorney, Agent, or Firm*—Pillsbury Winthrop LLP

(57) ABSTRACT

A floor covering mat is provided for protecting floor surfaces from scratches and spills during appliance movement and repair. The mat is defined by first and second panels that are interconnected with a hinge so that the mat can be extended for disposition in front of an appliance to be services or can be folded for storage and transport. At least a side edge of the mat has a beveled edge or other thickness transition section to facilitate the sliding or rolling movement of an appliance onto and off of a mat.

10 Claims, 5 Drawing Sheets

PORTABLE PROTECTIVE FLOOR COVERING MAT FOR APPLIANCES

BACKGROUND OF THE INVENTION

1. Field of Invention

The present invention relates to a portable floor covering mat that protects floor surfaces from scratches and stains that can occur, for example, during appliance movement and repair.

2. Description of the Related Art

Heavy appliances, such as refrigerators and dishwashers, are occasionally moved outwardly from walls to make repairs and/or for cleaning. However, movement of these large appliances often results in unsightly scratches and marks on floor surfaces; such as linoleum, tile and hardwood. In addition, oil, grease or other materials can spill during appliance movement and repair, potentially staining floor surfaces.

Surprisingly few floor surface protectors have been developed to protect the floor surfaces when moving heavy appliances outwardly from a wall. It has been proposed to place protective strips under the feet or legs of the appliance. One such product, marketed as Glide Guard™ Floor Protectors, includes two narrow strips to be placed under the legs or wheels of the appliance at the time of installation of the appliance. When the appliance is to be moved, additional strips are attached to extend the protector forward from the front of the appliance. Once the strips are in place, the user pulls the appliance forward and away from the wall along these strips. Implementing prior known protectors like the Glide Guard™ Floor Protectors requires an owner to have sufficient foresight to place strips under the feet of the appliance at he time of installation in order to take advantage of these protectors in the future. otherwise the consumer must align the strips with the feet of the appliance and attempt to move/lift the appliance on to the strips.

In either case, pulling an appliance away from the wall often involves rocking he appliance side-to-side. The narrow width of products like the Glide Guard™ floor Protectors, provides little leeway for sideward movement of the appliance. arrow strips also do not protect the floor surface from spills or leaks that occasionally occur during repairs. Moreover such products are not robust for commercial use nor readily transportable. Thus, there remains a need for a portable structure that protects floor surfaces from scratches and spills during appliance movement and repair.

SUMMARY OF THE INVENTION

The main objective of the floor covering mat of the invention is to provide protection to floor surfaces from scratches and spills during appliance movement and repair.

An additional objective of this invention is to provide a floor covering mat that does not require prior installation of parts and that is readily portable to any location for immediate use.

A further objective of this invention is to provide a floor covering mat that may be easily cleaned after use.

The foregoing and other objects of the present invention are realized by providing a floor covering mat defined by first and second panels interconnected with a hinge so that the mat can be extended for disposition in front of an appliance to be serviced or folded for storage and transport. At least one side of each panel has a thickness transition section, such as a bevel, to facilitate sliding or rolling movement of the appliance onto the mat. Moreover, the panels are hingedly connected so that the thickness transition sections thereof form a substantially continuous longitudinal edge of the mat, to accommodate the full width of the appliance. When the floor covering mat is in an open, ready to use position, one surface of each panel is in substantial contact with the floor. Therefore, the hinge structure is preferably flush with or recessed from the floor contacting surface.

In accordance with a further feature of the invention, the ends of the panels remote from the hinge structure are provided with a handle structure to facilitate lifting and transport of the mat in its folded disposition.

Other objects, features, and characteristics of the present invention, as well as the methods of operation and functions of the related elements of structure, and the combination of parts and economies of manufacture, will become more apparent upon consideration of the following description and the appended claims with reference to the accompanying drawings, all of which form a part of this specification, wherein like reference numerals designate corresponding parts in the various figures.

DETAILED DESCRIPTION OF THE INVENTION

Figure 1:
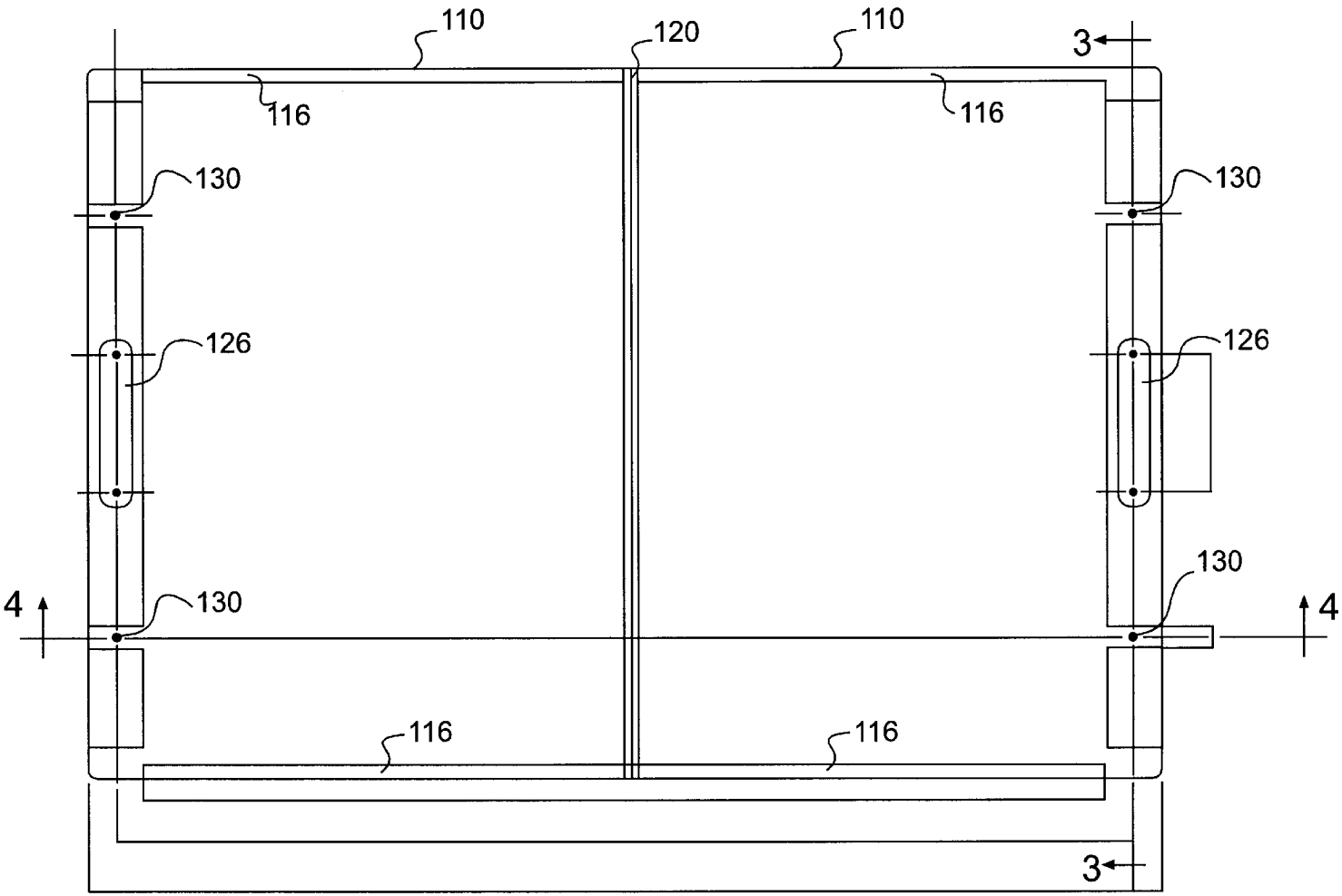
FIG. 1 is a plan view of the floor covering mat of the present invention disposed in its extended, ready-to-use disposition.

A floor covering mat 100 provided in accordance with the present invention is illustrated by way of example in FIG. 1, disposed in its extended configuration, ready to underlay an appliance 102 to be displaced, to protect floor surfaces 104 from scratches and spills that can occur during appliance 102 movement and repair.

For convenience and ease of description of the apparatus, directional terminology; such as length and width will be used. With reference to the illustrated embodiment, length will be used to refer to the dimension that extends parallel to the edge disposed in facing relation to the legs/wheels 106 of the appliance 102. Width refers to the dimension that extends perpendicular to the length. Use of these descriptions are not intended to limit the invention in any way.

As noted above, mat 100 is adapted to protect floor surfaces 104, such as hardwood, tile and linoleum, from marks, scratches and stains which can occur when sliding a heavy appliance 102, such as a refrigerator or dishwasher, away from a wall for servicing. Accordingly, mat 100 has a length of a size to receive the full width of refrigerators, dishwashers, and the like that it is intended to receive. On the other hand the mat 100 is adapted to be readily transported from service location to service location and stored between uses. Thus, the mat provided in accordance with the invention can be extended for use and dimensionally reduced for storage and transport.

In the illustrated embodiment, the mat is defined by at least two square or rectangular panels 110 that are interconnected by a hinge structure 120. The panels 110 are each sized so that when the mat is in its extended, full length disposition, with the panels disposed end to end, the mat will receive the full width of the appliance to be serviced and, preferably, accommodate any modest lateral displacement of the appliance during the appliance pull out process. Furthermore, the panels are each sized so that the extended mat will receive at least about 50% of the full depth of the appliance to be serviced. This dimensional characteristic was determined as a result of the limited amount of floor space the mat can maintain without being too large in confining areas, i.e. apartments, thereby making it more universal in design and use. Thus, in accordance with the presently preferred embodiment, when the appliance must be removed completely from the confining wall area, it is simply slid onto the working depth of the mat, as discussed in greater detail below, and then both the mat and the appliance (when tilted) are moved out from the wall together on the low friction surface of the mat bottom.

In the illustrated, presently preferred embodiment, the mat is composed of two panels for ease of manufacture and handling. However, if the size of the panels 110 required to accommodate a particular appliance 102 is such that even folded, providing two panels is not deemed readily portable or stowable, the mat 100 may be composed of multiple panels 110 of a smaller size.

The material selected for the panels 110 should preferably be a low friction material. Providing a low friction material facilitates sliding movement of the heavy appliance 102 from the floor surface 104 to the protective floor mat 100.

As the mat 100 is intended for repeated use, the material should also demonstrate resilience and low wear. Using a resilient material for panels 110 will reduce the likelihood that the panels will crack or chip under load, or themselves mar the floor. Moreover, advantageously, resilient panels 110 will maintain their shape and can be flexed as necessary or desirable during transport and use. Providing a low wear material ensures that the panels 110 are not easily worn down or rutted by repeated use.

During the course of appliance 102 movement and repairs, oil, grease and others may spill. Thus, the material selected for the panels should be non-absorptive, to simplify the cleanup of the mat 100. Finally, as the mat 100 intended to be portable, a light weight material is preferred.

An exemplary materials exhibiting the above properties are Ultra High Molecular Weight Polyethylene and High Density Polyethylene. For preliminary manufacturing, i.e. machined, the former has been used. However, higher volume production will likely be injection molded using the latter, since Ultra High Molecular Weight Polyethylene can not be injection molded. Other materials exhibiting the above noted characteristics and suitably adapted to the contemplated manufacturing process may be utilized in the alternative.

Figure 2:
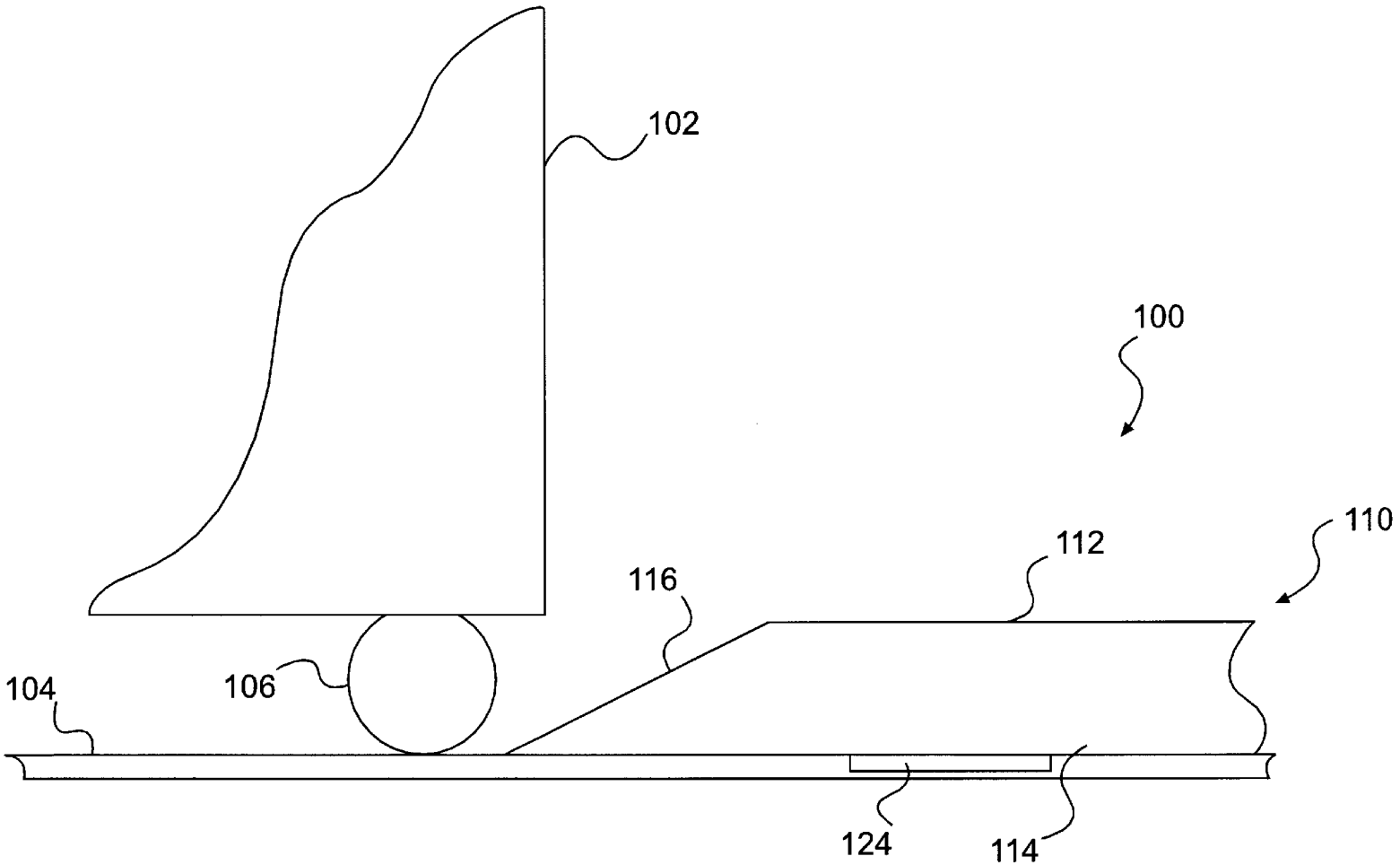
FIG. 2 is a schematic, enlarged elevational view of the floor covering mat in position for use with an appliance.
Figure 3:
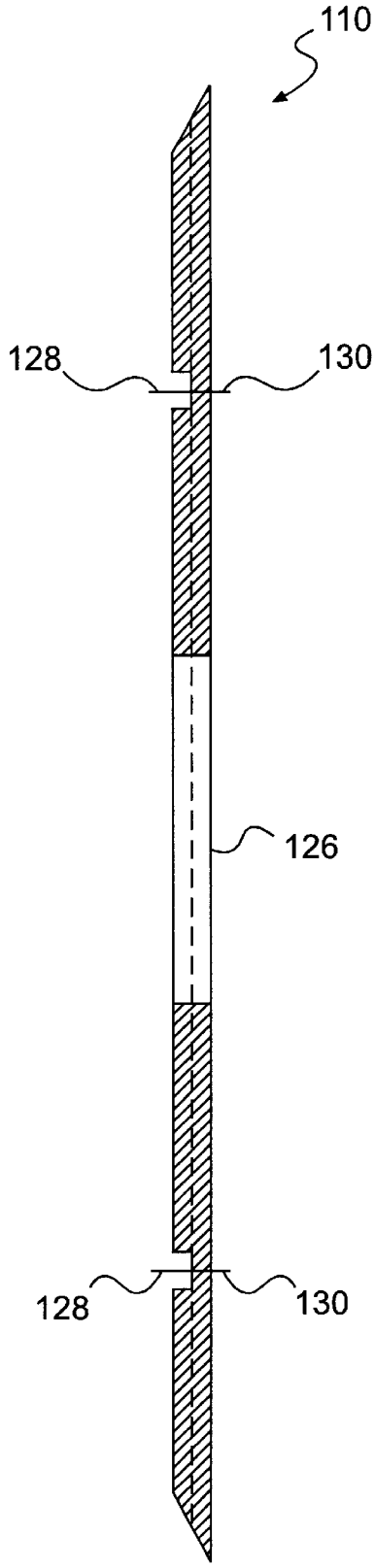
FIG. 3 is a widthwise cross-section of the floor covering mat along section line 3—3 of FIG. 1.

Each panel 110 is formed as a thin, flat panel with an upper surface 112 and a lower surface 114, as shown in FIG. 2. The thickness of the panels 110 should be sufficient to support the weight of the appliance 102 without cracking. At the same time, the thickness of the panels 110 should not render the mat 100 too heavy for transport, or cost-prohibitive to make.

At least one longitudinal edge of each panel 110 is configured to have a thickness transition section 116, as shown in FIG. 1. Inclusion of a thickness transition section 116 along a side edge of the panel 110 allows the legs/wheels 106 of the appliance 102 to be shifted with relative ease from the floor surface 104 to the mat 100 without lifting the appliance 102, as shown in FIG. 2. In the illustrated, presently preferred embodiment the thickness transition section 116 is a beveled edge that extends downwardly and outwardly at a modest angle from the upper surface 112 to the lower surface 114. In an exemplary embodiment, the angle of the beveled edge 116 is between about 5 degrees and about 30 degrees, but preferably about 15 degrees. Note that in the illustrated embodiment the thickness transition section 116 extends the entire face length of the mat. This best serves the removal of an appliance when it is positioned directly up against a wall. Although as presently proposed the thickness transition sections are smooth surfaced beveled edges, other types of thickness transition sections, such as stepped edges having a series of discrete yet minute steps may be provided.

As noted above, in the presently preferred embodiment, the lower surface of the mat is a low friction surface, so that it is possible to slide the appliance and mat together once the appliance is positioned on the top working surface of the mat, over the surface of the floor with relative ease. Nevertheless, it may be desired, in some environments or applications of the inventive mat to provide sections 124 of the lower surface of the panels 110 that are textured or have friction or grip pads applied or molded thereto to minimize movement of the mat 100 relative to the floor surface 104, particularly when the user is displacing the appliance 102 on to the mat 100.

The panels 110 are interconnected by a hinge structure 120 disposed along adjacent end edges of the panels 110. To avoid marring the floor and to present a mat lower surface that is substantially flush with the floor, the hinge structure is preferably flush with or recessed relative to the lower surface 114. Although not critical, the hinge structure is preferably flush with or recessed relative to the upper surface as well so that the hinge does not present an obstacle, and to avoid floor damage should the mat be placed on the floor upside down.

In the illustrated, presently preferred embodiment, the hinge structure is a living hinge, as such a hinge is well suited to the proposed material for the mat, is cost effective and easy to form, and lays flush with one surface. In the illustrated embodiment, the living hinge is defined so that the mat folds with the lower, floor contacting surfaces facing each other. As such dust and dirt that might be present on the floor and transferred to the mat will be less likely to dirty other surfaces or clothing.

The hinge 120 connects the panels 110 in a configuration that aligns the beveled edges of panels 110 so that the beveled edges define a substantially continuous edge of the mat 100. In the illustrated embodiment, both longitudinal edges of the mat 100 are beveled so that either longitudinal edge may be placed in front of the appliance to be moved.

Figure 5:
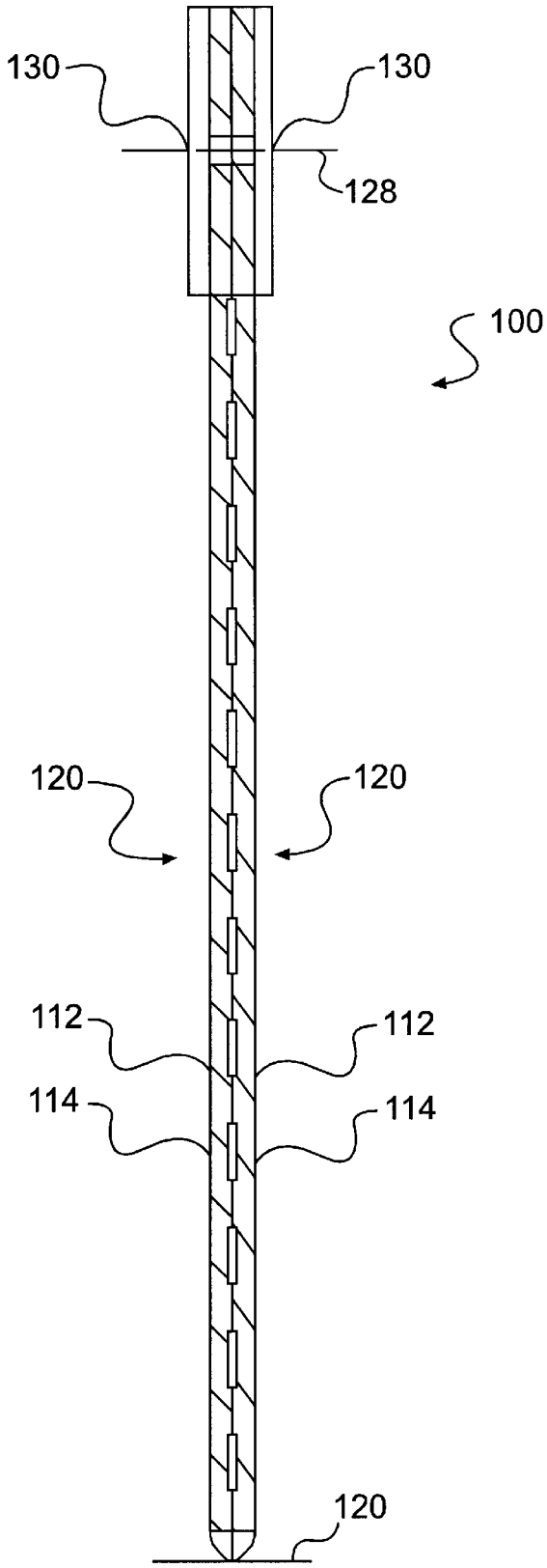
FIG. 5 is a schematic cross-sectional of the floor covering mat in a folded disposition.

As shown in FIG. 5, the hinge 120 allows the panels 110 to fold along the hinge 120 into a folded position, wherein, depending on the orientation of the hinge, either the upper surfaces 112 or lower surfaces 114 of the panels 110 are in close proximity to each other. The folded position places the mat 100 in a compact form for easy transport and storage. If there are more than two panels 110 forming the mat 100, the hinges 120 may allow the panels 110 to be fold in an accordion style to form a compact portable structure.

To facilitate the transport of the mat 100, handles 126 and/or fasteners 128 may be provided. Handles 126 allow the mat 100 to be comfortably transported in a folded position. The handles 126 may be formed as a part of the mat

Figure 4:
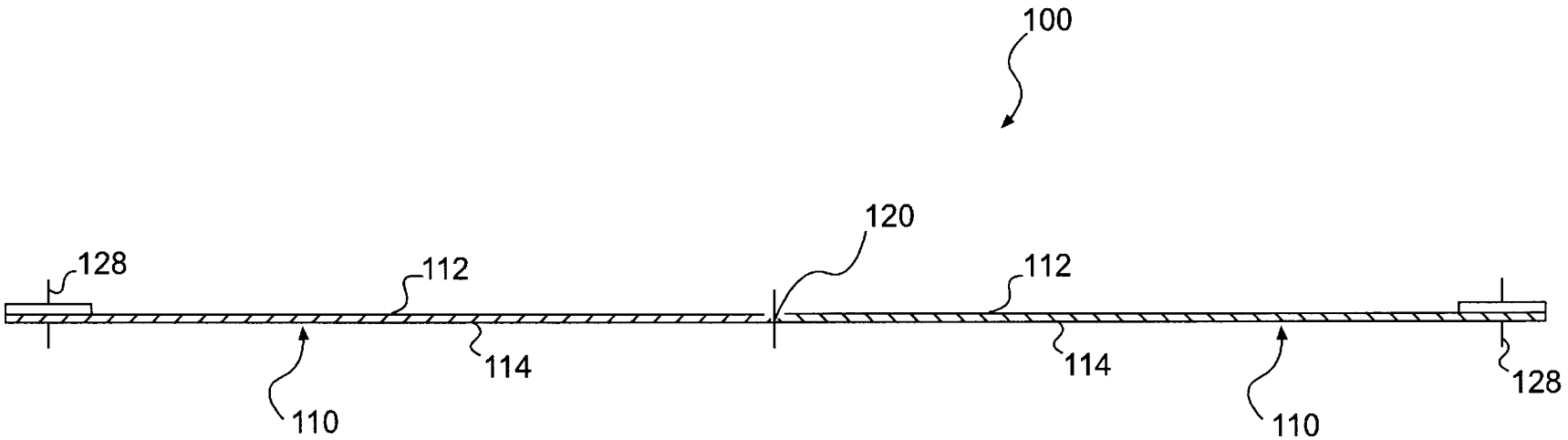
FIG. 4 is a lengthwise cross-section of the floor covering mat along section line 4—4 of FIG. 1.

100 or attached as a separate component for transport. Thus, handles 126 may be formed near an edge of each panel 110 as an aperture of a size sufficient to accommodate an adult hand, as shown in FIG. 1. Length may be added to the end of each panel 110 for the sole purpose of defining handles 126 in to the panels 110. The added length may consist of a thicker material to provide a more comfortable grip to the handles 126, as shown in FIGS. 4 and 5. In the alternative handles 126 may also be simply formed from a strap configured to transport the mat 100. If desired, holes may be formed in the panels 110 to provide a place to secure the handles to the mat 100. Although in the illustrated embodiment, the handles are adapted to be provided at the ends of the mat, it is to be understood that in the alternative, although less desirably, handles may be defined or attached along the side edges of the mat.

Fasteners 128, which are schematically depicted as lines through holes 130, may also be included to improve the portability and storability of the mat 100 by maintaining its compact, folded position. Fasteners 128 may be either integrated into the mat 100 or formed as a separate piece only to be attached at times of transport and storage. Forms of integrated fasteners 128 include magnets mounted or molded to the panel end portions so that they are in close proximity to each other when the mat 100 is in a folded position. Alternate fasteners 128 include U-shaped clips, threaded shafts and wing nuts, ties, straps with velcro or snaps, and the like. Holes 130 may be formed in the panels 110 to secure the position of the fasteners 128 to the mat 100.

The design of the mat 100 allows the present invention to be simply implemented. As shown in FIG. 2, a user places a beveled longitudinal edge of the mat 100 adjacent the front legs/wheels 106 of the appliance 102. Once the mat 100 is in place, the user guides the appliance 102 by generally pulling and sliding the appliance 102 onto the mat 100. When the repairs are complete, the user returns the appliance 102 to its original position by pushing and sliding the appliance 102 down the beveled edge 116 to the floor surface 104. Following use, the mat 100 may be readily cleaned if desired, folded, and fastened, if desired. After folding, the mat 100 may be transported and/or stored for future use in its folded position.

While the invention described in connection with what is presently considered to be the more practical and preferred embodiment, it is not to be limited to the disclosed embodiment, but on the contrary is intended to cover various modifications and equivalent arrangements included within the spirit and scope of the appended claims.

What is claimed is:

1. A floor covering mat for protecting floor surfaces from scratches and stains that may occur during appliance movement and repair, comprising:

a first panel and a second panel each having a first, borne object engaging surface and a second, floor engaging surface; a first side edge and a second side edge; and a first end and a second end, wherein at least one side edge of each panel includes a thickness transition section from the borne object engaging surface towards the floor engaging surface, defining a transitional thickness reduction towards a minimum thickness; and a hinge structure integrally formed with the panels and made from a material comprising the panels, said hinge structure connecting the second end of the first panel to the first end of the second panel in a configuration that aligns the side edges of each panel to form a substantially continuous edge of the floor covering mat, wherein the floor covering mat has an open, ready to use configuration wherein said second surfaces of said panels are in substantial contact with the floor surface, wherein the hinge is one of flush with and recessed from said second surfaces, and wherein the panels are pivotable about said hinge such that at least one of said first surfaces or second surfaces of said panels may be disposed in close proximity to each other;

wherein the first end of said first panel and the second end of said second panel each have a thickness greater than a thickness of a remainder of said panels.

2. The mat of claim 1, further comprising at least one handle to facilitate the transport of the floor covering mat.

3. The mat of claim 2, wherein a first aperture is defined adjacent the first end of said first panel and a second aperture is defined adjacent the second end of said second panel for carrying said panels in a folded disposition.

4. The mat of claim 1, further comprising at least one fastener for maintaining the folded disposition of the floor covering mat.

5. The mat of claim 1, further including a friction enhancing structure provided on the floor engaging surfaces of each panel.

6. The mat of claim 1, wherein said thickness transition section of each of said panels comprises a beveled edge having a smooth, inclined surface.

7. The mat of claim 6, wherein said bevel is inclined to horizontal at an angel of between about 5 and 30°.

8. The mat of claim 6, wherein said beveled edged is inclined at an angle of about 15°.

9. The mat of claim 1, wherein the hinge comprises a living hinge defining a reduced thickness portion between said panels.

10. The mat of claims 1, wherein said mat is formed from a material selected from the group consisting of ultra high molecular weight polyethelene and high density polyethelene.

* * * * *